US011490181B1

(12) United States Patent
Choong et al.

(10) Patent No.: US 11,490,181 B1
(45) Date of Patent: Nov. 1, 2022

(54) DEVICE WITH WATER DRAINAGE FOR A SPEAKER USING A THREE-DIMENSIONAL CANOPY SHAPED RETAINER AND HYDROPHOBIC MESH

(71) Applicant: MOTOROLA SOLUTIONS, INC., Chicago, IL (US)

(72) Inventors: Ji Ying Choong, Bayan Lepas (MY); Kuang Eng Lim, Bayan Lepas (MY); Geng Xiang Lee, Bayan Lepas (MY); Sze Yen Lim, Bayan Lepas (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 17/373,125

(22) Filed: Jul. 12, 2021

(51) Int. Cl.
*H04R 1/02* (2006.01)
*H04R 1/08* (2006.01)

(52) U.S. Cl.
CPC ..... *H04R 1/023* (2013.01); *H04R 1/086* (2013.01); *H04R 2400/01* (2013.01)

(58) Field of Classification Search
CPC ..... H04R 1/023; H04R 1/086; H04R 2400/01
See application file for complete search history.

(56) References Cited

U.S. PATENT DOCUMENTS

| | | | | |
|---|---|---|---|---|
| 10,341,752 | B2 | 7/2019 | Miehl et al. | |
| 11,240,576 | B1 * | 2/2022 | Lim | H04R 1/023 |
| 2019/0111456 | A1 * | 4/2019 | Aase | B08B 1/005 |
| 2020/0304928 | A1 | 9/2020 | Fuglsang-Phillip et al. | |
| 2021/0152903 | A1 | 5/2021 | Mietta et al. | |
| 2021/0258705 | A1 * | 8/2021 | McIntosh | H04R 1/1016 |

* cited by examiner

*Primary Examiner* — Sunita Joshi
(74) *Attorney, Agent, or Firm* — Perry + Currier, Inc.

(57) ABSTRACT

A device with water drainage for a speaker using a three-dimensional canopy shaped retainer and hydrophobic mesh is provided. The device includes a three-dimensional (3D) retainer having a canopy shape with an outer side and an inner side, the outer side having a generally convex shape and the inner side having a generally concave shape, the 3D retainer comprising apertures therethrough. The device further includes a hydrophobic mesh located at least at the apertures at the outer side of the 3D retainer, the hydrophobic mesh being air-permeable.

20 Claims, 8 Drawing Sheets

DEVICE WITH WATER DRAINAGE FOR A SPEAKER USING A THREE-DIMENSIONAL CANOPY SHAPED RETAINER AND HYDROPHOBIC MESH

BACKGROUND OF THE INVENTION

Some portable electronic devices that include speakers, such as remote speaker microphones (RSMs), and the like, are often exposed to water, such as rain, water spray, mist and the like, which can get into speaker cavities, and the like, of the portable electronic devices, and block and/or degrade speakers.

BRIEF DESCRIPTION OF THE SEVERAL VIEWS OF THE DRAWINGS

In the accompanying figures similar or the same reference numerals may be repeated to indicate corresponding or analogous elements. These figures, together with the detailed description, below are incorporated in and form part of the specification and serve to further illustrate various embodiments of concepts that include the claimed invention, and to explain various principles and advantages of those embodiments.

Figure 1:
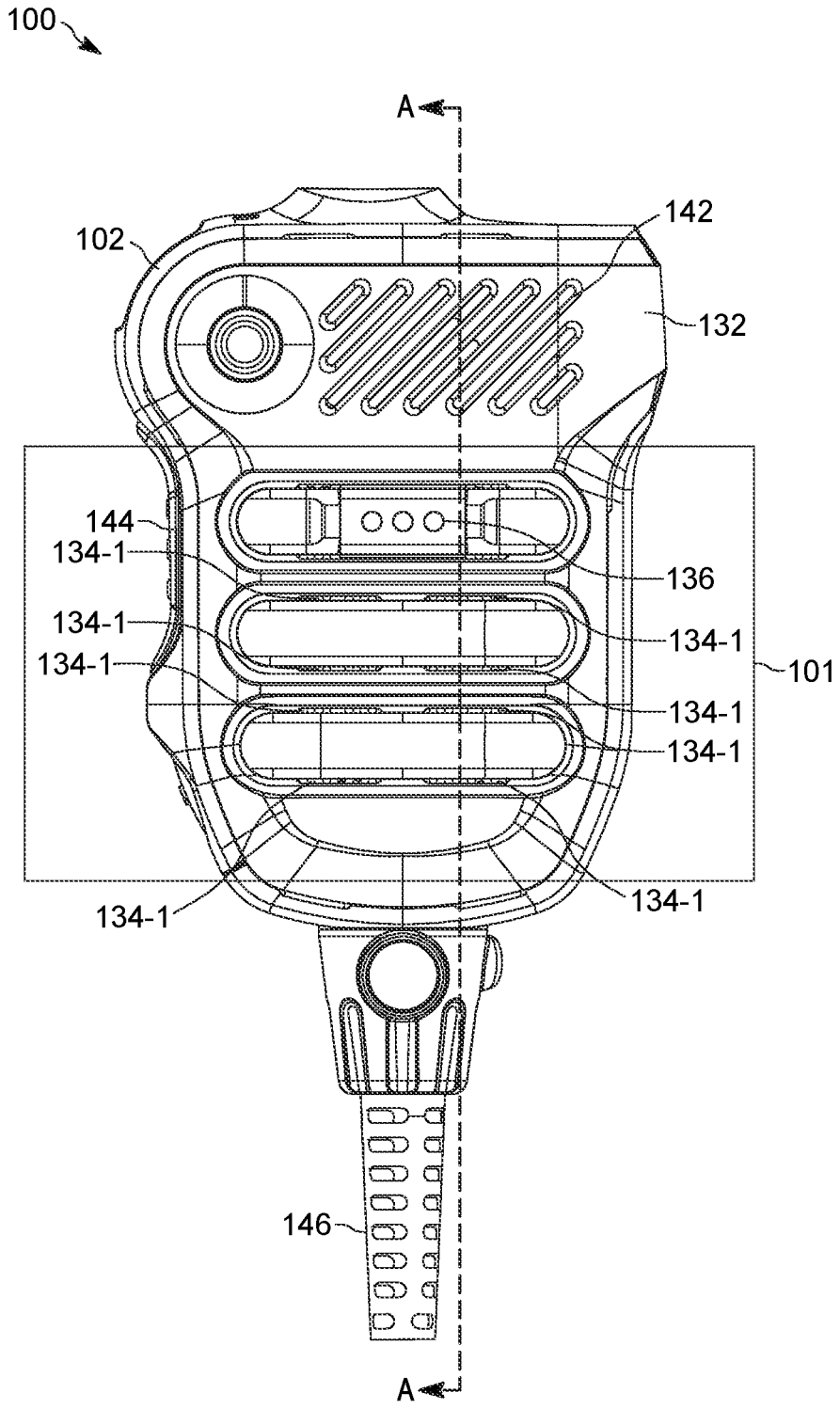
FIG. 1 is a front view of a portable electronic device with water drainage for a speaker using a three-dimensional canopy shaped retainer and hydrophobic mesh, in accordance with some examples.

Skilled artisans will appreciate that elements in the figures are illustrated for simplicity and clarity and have not necessarily been drawn to scale. For example, the dimensions of some of the elements in the figures may be exaggerated relative to other elements to help improve understanding of embodiments of the present disclosure.

The system, apparatus, and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Some portable electronic devices that include speakers, such as remote speaker microphones (RSMs), and the like, are often exposed to water, such as rain, water spray, mist and the like, which can get into speaker cavities, and the like, of the portable electronic devices, and block and/or degrade speakers. Similarly, such portable electronic devices may be exposed to dust and/or ash (e.g. when carried by firefighters, and the like), which may require the portable electronic devices to be rinsed to remove the dust and/or ash, again exposing the portable electronic devices to water and blocking and/or degrading speakers. Such blockage and/or degradation can cause the speakers to operate poorly, which may cause unintelligible speech at the device (e.g. from a speaker). In a worst case scenario, such portable electronic devices may be placed on a surface and/or held with the speaker facing in an upwards direction, and the like, such that water may pool at the speaker, which may block and/or damage the speaker. Thus, there exists a need for an improved device and/or portable electronic device with water drainage for a speaker.

Hence, provided herein is a device that includes a three-dimensional (3D) retainer having a canopy shape with an outer side and an inner side, the outer side having a generally convex shape and the inner side having a generally concave shape, the 3D retainer comprising apertures therethrough. The device further includes a hydrophobic mesh, such as a monofilament-based technical fabric, located at least at the apertures at the outer side of the 3D retainer, the hydrophobic mesh being air-permeable.

The device may be incorporated into a portable electronic device, and/or any other suitable electronic device and/or communication device, and the like, that includes a speaker, for example mounted in a cavity. Moisture and/or water may generally enter the portable electronic device through various apertures and/or speaker ports. However, the 3D retainer may be mounted over at least a portion of the cavity, including the speaker, with the inner side facing the speaker, and the hydrophobic mesh facing outwards, for example towards various apertures and/or speaker ports of the portable electronic device.

As such, when the portable electronic device is in a position where the speaker and/or the outer side of the 3D retainer is facing in an upwards direction, and moisture collects on the hydrophobic mesh, for example when water is poured onto the portable electronic device, the moisture and/or the water runs in a downward direction away from a center of the 3D retainer and further is generally repelled by the hydrophobic mesh.

The portable electronic device may further comprise drainage features and/or wicking features which drains and/or wicks the water away from the hydrophobic mesh and, for example, out of the portable electronic device.

An aspect of the present specification provides a device comprising: a three-dimensional (3D) retainer having a canopy shape with an outer side and an inner side, the outer side having a generally convex shape and the inner side having a generally concave shape, the 3D retainer comprising apertures therethrough; and a hydrophobic mesh located at least at the apertures at the outer side of the 3D retainer, the hydrophobic mesh being air-permeable.

Another aspect of the present specification provides a portable electronic device comprising: a housing having a cavity; a speaker mounted in the cavity; a three-dimensional (3D) retainer over at least a portion of the cavity, including the speaker, the 3D retainer having a canopy shape with an outer side and an inner side facing the speaker, the outer side having a generally convex shape and the inner side having a generally concave shape, the 3D retainer comprising apertures therethrough; and a hydrophobic mesh located at least at the apertures at the outer side of the 3D retainer, the hydrophobic mesh being air-permeable.

Each of the above-mentioned embodiments will be discussed in more detail below, starting with example system and device architectures of the system in which the embodiments may be practiced.

Further advantages and features consistent with this disclosure will be set forth in the following detailed description, with reference to the figures.

Herein, the terms water and moisture are generally used interchangeably, such that "moisture" may refer to "water" and vice versa; hence, properties of various materials and/or components are described herein as being hydrophobic or hydrophilic, which are understood to, respectively, repel or attract water and/or moisture.

Figure 2:
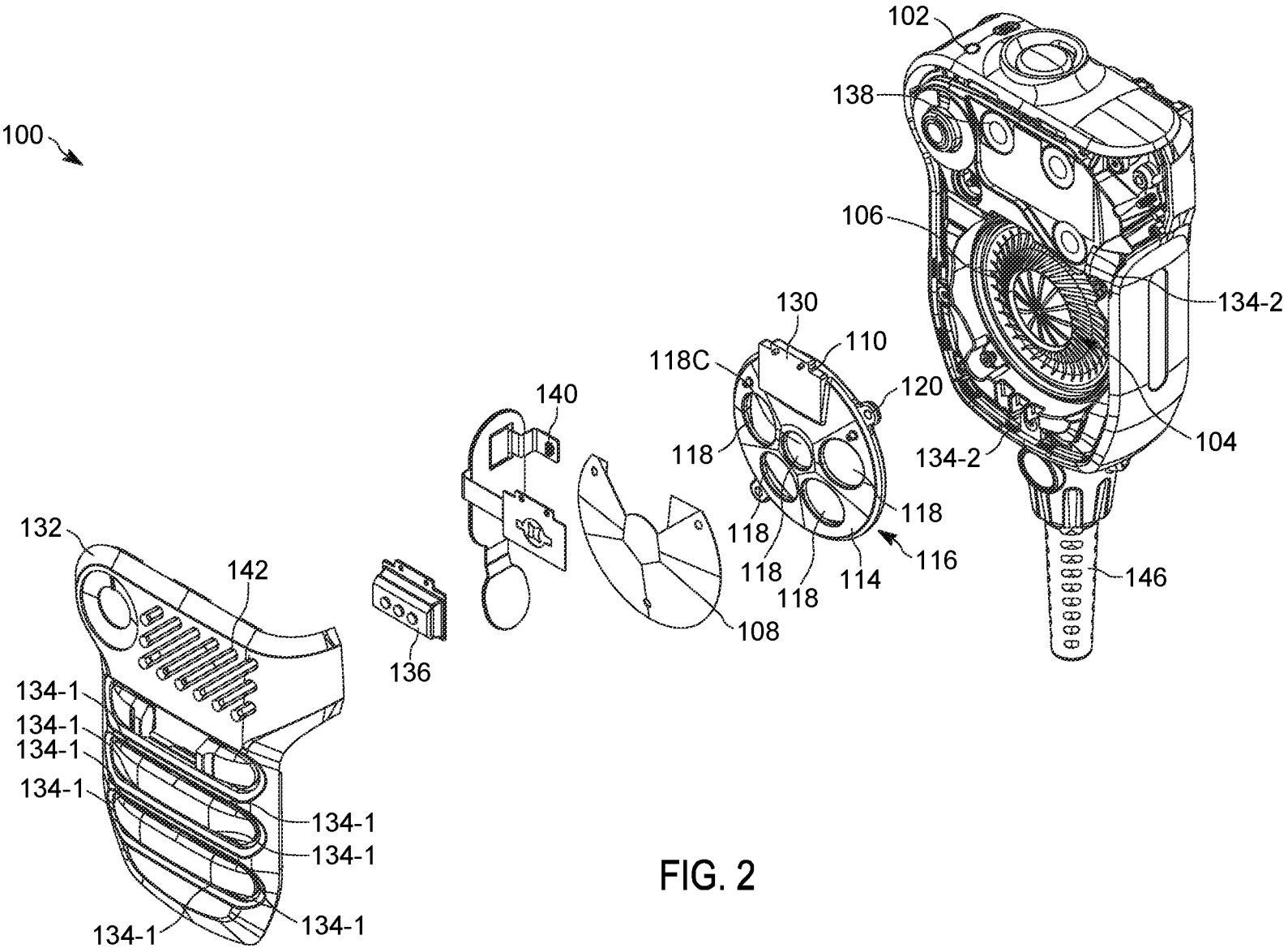
FIG. 2 depicts a perspective of an exploded view of the portable electronic device of FIG. 1, in accordance with some examples.

Attention is directed to FIG. 1 and FIG. 2, which respectively depict a front view and an exploded view of a portable electronic device 100 with water drainage for a speaker using a three-dimensional canopy shaped retainer and hydrophobic mesh, in accordance with some examples. As depicted the portable electronic device 100 comprises a remote speaker microphone (and/or a radio speaker microphone), however the portable electronic device 100 may comprise any suitable device and/or portable electronic device with water drainage for a speaker, as described hereafter. In some examples, the portable electronic device 100 may comprise a body wearable device, such as the depicted remote speaker microphone, and/or another body wearable device. In particular examples, the portable electronic device 100 may comprise a shoulder mountable wearable device (such as a shoulder mountable RSM and/or another shoulder mountable wearable device).

However, the portable electronic device 100 may include any suitable device that includes a speaker in a cavity that may be adapted to include water drainage for the speaker using a three-dimensional canopy shaped retainer and hydrophobic mesh, as described hereafter, including, but not limited to, portable device, a cell phone, a radio device, a laptop computer, and the like and/or a non-portable device. A region 101 is further indicated, and a cross-section of the region 101 through a line A-A is described below with reference to FIG. 7.

The portable electronic device 100 will next be described in more detail with further reference to FIG. 1 and FIG. 2, as well as FIG. 3, and FIG. 4 which show a device that includes a three-dimensional canopy shaped retainer and hydrophobic mesh which may be incorporated into the portable electronic device 100.

With reference to FIG. 1 and FIG. 2, the portable electronic device 100 generally comprises a housing 102 and, as best seen in FIG. 2, the housing 102 includes a cavity 104. As also best seen in FIG. 2, a speaker 106 is generally mounted in the cavity 104. While as depicted the cavity 104 is circular, the cavity 104 may be any suitable shape.

As also best seen in FIG. 2, the portable electronic device 100 further comprises a hydrophobic mesh 108 and three-dimensional (3D) retainer 110 for the hydrophobic mesh 108. In some examples, the hydrophobic mesh 108 and the three-dimensional (3D) retainer 110 may be provided as a pre-assembled separate device 112, which is shown in more detail in FIG. 3, in a perspective exploded view, and in FIG. 4, in a front assembled view.

The 3D retainer 110 generally has a canopy shape with an outer side 114 and an inner side 116. For example, to form the canopy shape, the outer side 114 has a generally convex shape and the inner side 116 has a generally concave shape. Indeed, the canopy shape can be formed in any suitable manner. In particular, as depicted, the 3D retainer 110 has a widest and/or highest region at about a center of the 3D retainer, and narrows towards the edges. Put another way, the 3D retainer 110 may generally comprise a spherical cap and/or a spherical segment, however, use of the terms "canopy" and/or "spherical" are not meant to be limited to examples where the outer side 114 and/or the inner side 116 of the 3D retainer 110 are smooth. Similarly, use of the terms "convex" with respect to the outer side 114, and "concave" with respect to the inner side 116, not meant to be limited to examples where the outer side 114 and/or the inner side 116 of the 3D retainer 110 are smooth. Rather, as will be described herein, at least the outer side 114 may include facets, and the like, that meet at edges (e.g. similar to a geodesic polyhedron), and that may generally form the canopy shape.

As also best seen in FIG. 2 (and FIG. 3), the 3D retainer 110 generally comprises apertures 118 therethrough. Furthermore, the 3D retainer 110 is generally located over at least a portion of the cavity 104, including the speaker 106, with the inner side 116 of the 3D retainer 110 facing the speaker 106. In general, the apertures 118 generally allow sound from the speaker 106 to pass through the 3D retainer 110.

In particular, as depicted, one aperture 118C, of the apertures 118, is centrally located at the 3D retainer 110, and remaining apertures 118 are located, and/or partially located, around the one aperture 118C for example in an arc configuration. The position of the one aperture 118C, and/or central aperture 118C may be selected such that that, when the 3D retainer 110 is assembled in the portable electronic device 100 (e.g. using bolts, screws, and the like), the central aperture 118C is about centered on the speaker 106 (and/or is at about a center of the speaker 106) to provide a direct path for sound from the speaker 106 through the 3D retainer 110 (e.g. and hydrophobic mesh 108).

As depicted the 3D retainer 110 includes four apertures 118 arranged in arc around the central aperture 118C. Furthermore, in the depicted example, the apertures 118 are circular in shape, and have a diameter in range of about 9 mm to about 12 mm, with the central aperture 118C being smaller than the other apertures 118 due to geometrical constraints of the canopy shape of the 3D retainer 110. However, the arrangement and size of the apertures 118 was selected based on the size and geometry of the larger portable electronic device 100 of which the 3D retainer 110 is component. As such, the number and/or arrangement and/or size of apertures 118 may comprise any suitable number and/or arrangement and/or size.

In particular, a number and/or arrangement and/or size of the apertures 118 may be selected heuristically based on efficiency of sound from the speaker 106 transmitted therethrough. For example, the particular arrangement and size of apertures 118 depicted herein was found to have a "good" frequency response with the depicted portable electronic device 100 over human detectable frequency ranges (e.g. about 20 Hz to about 20 kHz). However, to maintain such a good frequency response, the 3D retainer 110 may include one central aperture 118C, and at least one other aperture 118, which may or may not be circular.

While the term "good" frequency response is a relative term, such a term is understood to include a profile of a frequency of sound emitted by the portable electronic device 100 compared to a target frequency profile in which buzzing (e.g. audio buzzing) does not occur and/or is minimized, and/or a defined frequency drop in a higher frequency range and/or a predetermined frequency range does not occur and/or is minimized. Indeed, the number and/or arrangement and/or size of the apertures 118 may be selected heuristically, and/or through computer modelling, such that sound emitted by the speaker 106 has a profile and/or frequency response that matches and/or about matches any suitable target frequency profile.

The 3D retainer 110 may be fabricated in any suitable manner from any suitable material. In some examples, the 3D retainer 110 may comprise one or more of a metal, steel, stainless steel, and a hard plastic, and/or a combination thereof. In particular, in some examples, the 3D retainer 110 may comprise any suitable die-cast metal, for ease of fabrication. However, the 3D retainer 110 may alternatively comprise a hard plastic that may be 3D printed and/or injection molded. Furthermore, the 3D retainer 110 may have any suitable dimensions that may be particular to a size and/or shape of the cavity 104 and/or speaker 106. Furthermore, a thickness of the 3D retainer 110 may be selected to reduce a likelihood of deformation thereof and which may hence depend on a type of material from which the 3D retainer 110 is formed. In particular examples, the 3D retainer 110 may have a thickness in a range of about 0.8 mm to about 1.5 mm, for example when the 3D retainer 110 is made from metal and/or hard plastic.

Figure 6:
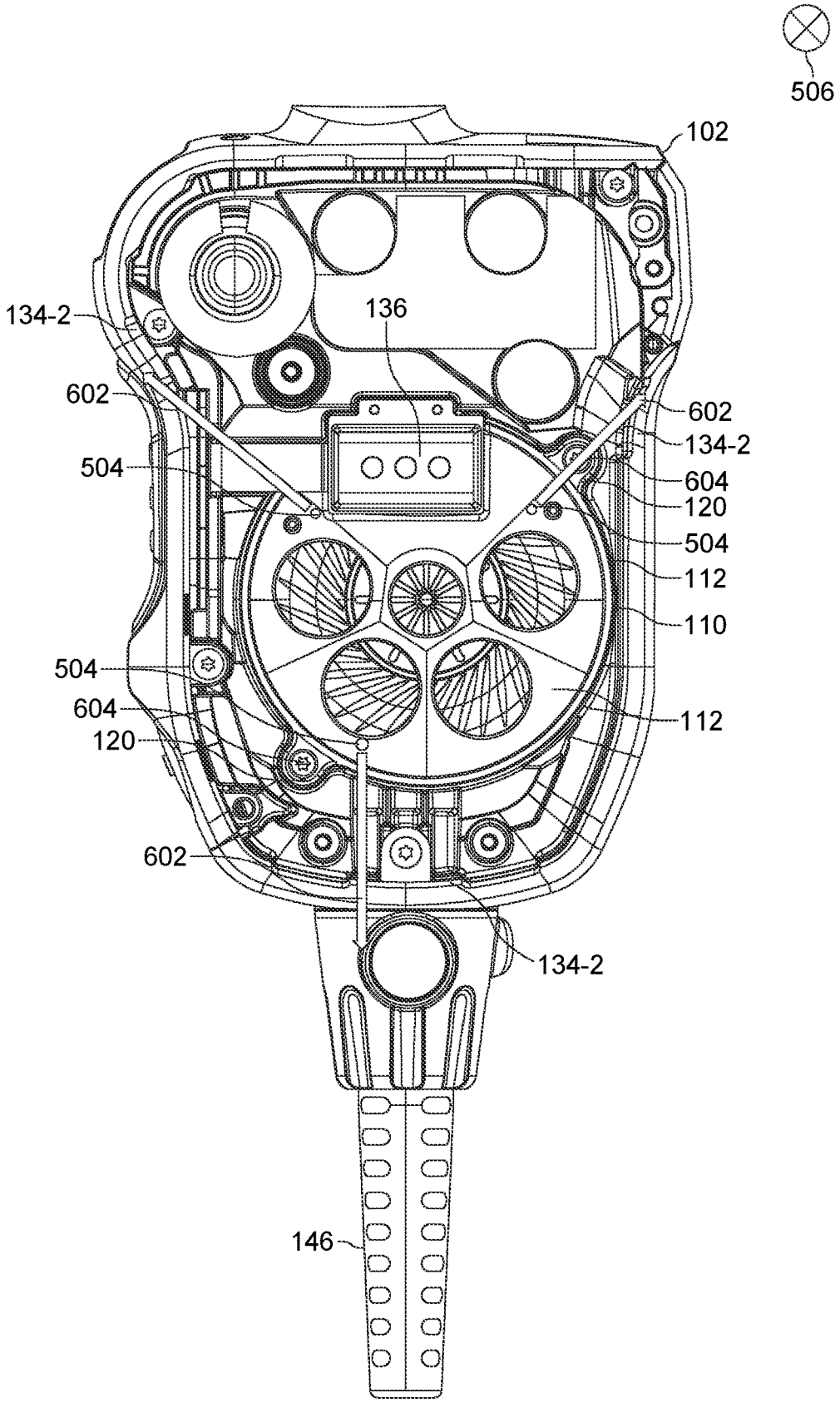
FIG. 6 depicts a front view of the device of FIG. 1 with a bezel removed, with the device facing in an upwards direction, in accordance with some examples

The 3D retainer 110 may be attached to the housing 102 of the portable electronic device 100 in any suitable manner. In a particular examples, as depicted, the 3D retainer 110 includes a pair of wings 120 (as best seen in FIG. 3) and/or extensions with bolt holes therethrough, and hence the housing 102 may include (not depicted) complementary located threaded holes for receiving bolts that may be placed through the bolt holes of the wings 120 (e.g. as depicted in FIG. 6).

In some examples, the hydrophobic mesh 108 may comprises one or more of a monofilament-based technical fabric, polyvinyl coated polyester (PES), and the like. The hydrophobic mesh 108 may comprise mesh apertures having a size of between about 20 microns and about 300 microns, and hence the hydrophobic mesh 108 is generally understood to be air permeable such that sound from the speaker 106 may pass therethrough. However, the hydrophobic mesh 108 may comprise any suitable hydrophobic material in the form of a mesh, and the like, which is air-permeable with any suitable size of apertures therein.

In particular, the hydrophobic mesh 108 may have a wettability corresponding to values of angle of contact (e.g. of water) that may be one or more of: greater than about 90° (degrees); and between about 180° and about 260°. In a particular example, the contact angle may be about 240°. However, the hydrophobic mesh 108 may have any suitable wettability that results in the hydrophobic mesh 108 being generally water repellent and/or hydrophobic.

The hydrophobic mesh 108 may be one or more of attached and bonded to the 3D retainer 110 at the outer side 114 of the 3D retainer 110 using any suitable adhesive, and the like including, but not limited to, a double-sided adhesive material. Furthermore, the 3D retainer 110 may comprise protrusions 122 (e.g. as depicted, three protrusions 122) and the hydrophobic mesh 108 may comprise complementary holes 124 therethrough. When the hydrophobic mesh 108 is attached to the 3D retainer 110 (as best seen in FIG. 4), the holes 124 are aligned with the protrusions 122, which retain the hydrophobic mesh 108 in a particular position relative to the 3D retainer 110.

Figure 3:
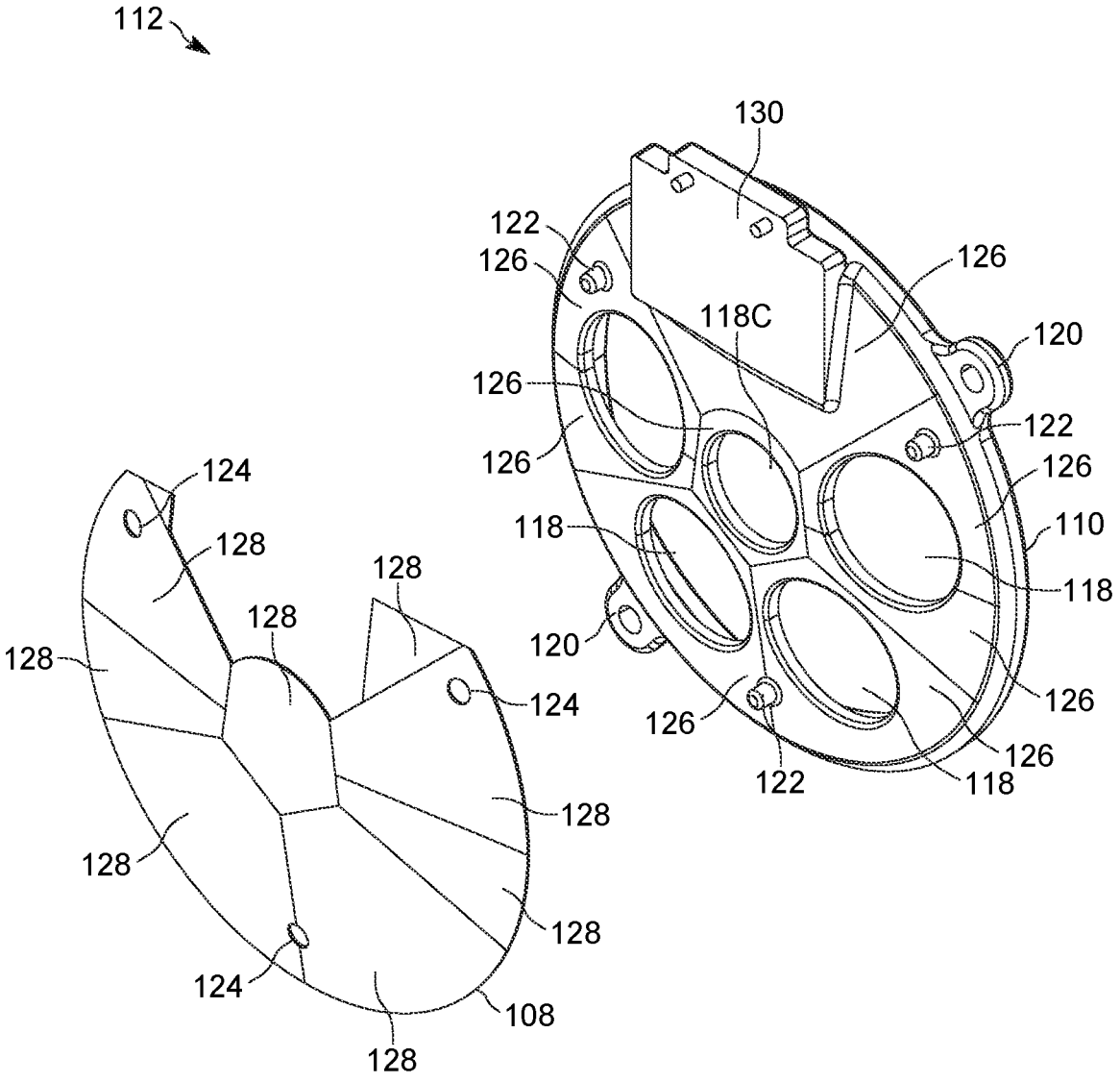
FIG. 3 depicts a perspective of an exploded view of a device that includes a three-dimensional canopy shaped retainer and hydrophobic mesh, in accordance with some examples.

Furthermore, with reference to FIG. 3, which shows the device 112 in more detail, regions around the apertures 118 of the 3D retainer 110 may comprise flat facets 126 to which the hydrophobic mesh 108 is attached. For example, the flat facets 126 generally form angles with adjacent flat facets 126 to form, and/or at least partially form, the generally convex shape of the outer side 114. As also best seen in FIG. 3, some apertures 118 may be through more than one flat facet 126.

Similarly, as depicted, the hydrophobic mesh 108 may comprise reciprocal facets 128, which may be formed during fabrication of the hydrophobic mesh 108 and/or during a process of attaching the hydrophobic mesh 108 to the 3D retainer 110. The hydrophobic mesh 108 may hence be assembled with the 3D retainer 110 using the holes 124 aligned with the protrusions 122, and by further using a double-sided adhesive material (e.g. which may be attached to suitable regions of a side of the hydrophobic mesh 108 facing the 3D retainer 110; and/or attached to a side of the 3D retainer 110 facing the hydrophobic mesh 108), such that the hydrophobic mesh 108 is attached to the 3D retainer 110 with the double-sided adhesive material. It is understood, however, that such a double-sided adhesive material, and the like, is present in regions of the hydrophobic mesh 108 that attach to the flat facets 126, but absent from regions that cover the apertures 118, such that the double-sided adhesive material does not block sound from the speaker 106.

In particular, the hydrophobic mesh 108 is understood to be attached to the 3D retainer 110 with the double-sided adhesive material, and the like at least at the flat facets 126, with corresponding facets 128 bonded thereto. Indeed, use of the facets 126, 128 may assist with to minimizing stretching of the hydrophobic mesh 108 when attaching to the 3D retainer 110, as compared to a 3D retainer having a curved outer side. Put another way, if the hydrophobic mesh 108 were being attached to a curved (e.g. non-flat) surface, the risk of stretching the hydrophobic mesh 108 may increase relative to the hydrophobic mesh 108 being attached to the flat surfaces of the flat facets 126. Nonetheless, the outer side 114 being curved is within the scope of the present specification. The inner side 116, however, may be curved (and/or of any other suitable concave shape including concave shapes formed using facets) as the hydrophobic mesh 108 is not generally attached thereto.

It is further understood that the number and/or size and/or arrangement of the apertures 118, and a respective number and/or size and/or arrangement of the flat facets 126, may be further selected heuristically to achieve "good" attachment of the hydrophobic mesh 108 to the 3D retainer 110. For example, "good" attachment may include the hydrophobic mesh 108 being attached to the 3D retainer 110 for a given period of time and/or the attachment being able to withstand given temperature ranges and/or given changes in temperature, and/or any other suitable given environmental conditions; indeed any adhesive used with the hydrophobic mesh 108 and the 3D retainer 110 may be selected based on given environmental conditions.

For example, when the apertures 118 are increased in size, surface area of the flat facets 126 may decrease in size, reducing the surface area of attachment between the hydrophobic mesh 108 and the 3D retainer 110. The depicted arrangement of the apertures 118, and the flat facets 126 was hence further selected both to achieve a good frequency response, and a good adhesion of the hydrophobic mesh 108 to the 3D retainer 110 (e.g. using a suitable double-sided adhesive material).

Figure 4:
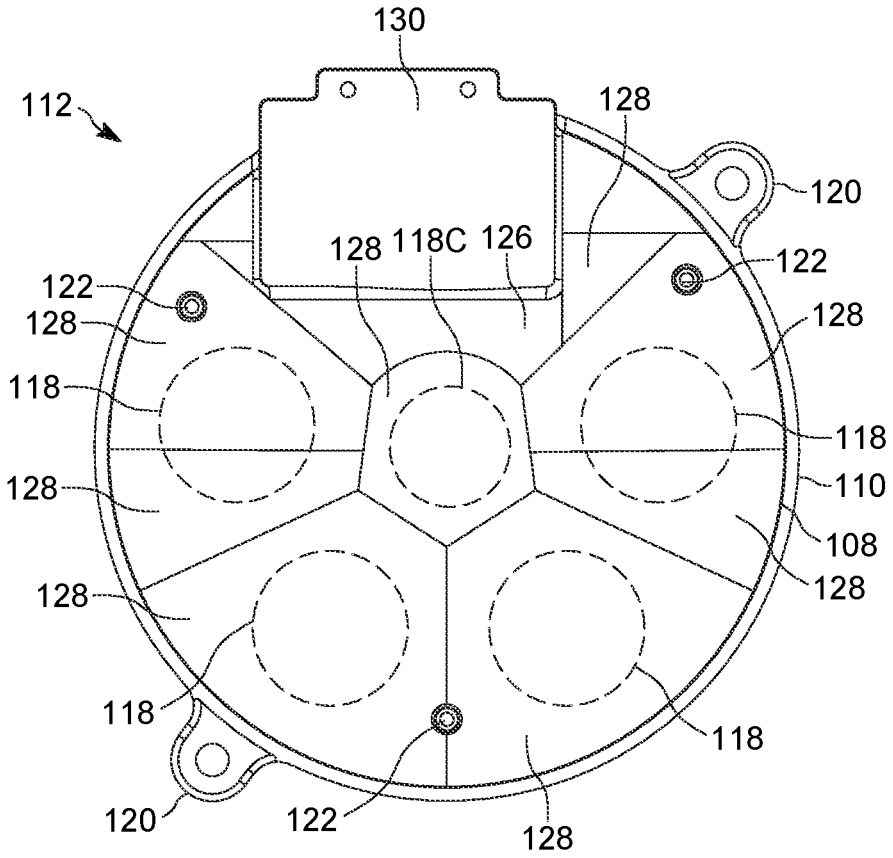
FIG. 4 depicts a front view of the device of FIG. 3, in accordance with some examples.

With reference to FIG. 4, the arrangement of the hydrophobic mesh 108, relative the apertures 118 is also shown, with the apertures 118 depicted in dashed lines indicating that, when the device 112 is assembled, the hydrophobic mesh 108 covers the apertures 118 to prevent moisture from entering the apertures 118. While most of the flat facets 126 of the 3D retainer 110 are not indicated in FIG. 4, the flat facets 126 of the 3D retainer 110 are nonetheless understood to be present, though covered by the hydrophobic mesh 108. As such, as will be described in more detail below with respect to FIG. 5 and FIG. 6, when moisture is at the hydrophobic mesh 108, the hydrophobic mesh 108 prevents the moisture from entering the apertures 118. Furthermore, the general canopy shape of the 3D retainer 110 and the hydrophobic mesh 108 causes the moisture to run towards edges of the 3D retainer 110 and away from the apertures 118. The moisture may be drained out of the portable electronic device 100 using drainage features and/or wicking features described in more detail below. In particular, the hydrophobic mesh 108 may assume, and/or conform to, the shape of the 3D retainer 110 at least when attached thereto, and/or the hydrophobic mesh 108 may have a canopy shape prior to being attached to the 3D retainer 110.

FIG. 4 also shows that the general canopy shape of the 3D retainer 110 and the hydrophobic mesh 108 may be circular, with a size of the hydrophobic mesh 108 selected to be smaller than the size of the 3D retainer 110, while covering the apertures 118, such that the edges of the hydrophobic mesh 108 are also attached to the 3D retainer 110.

As also seen in FIG. 4, as well as FIG. 2 and FIG. 3, in some examples, the 3D retainer 110 may also comprises a flat, aperture free region 130 against which a biasing device of the interacts portable electronic device 100 interacts, as described in more detail below.

Indeed, attention is again directed to FIG. 1 and FIG. 2 which shows further features of the portable electronic device 100.

The portable electronic device 100 further comprises a bezel 132 covering a combination of the 3D retainer 110 and the hydrophobic mesh 108 (e.g. the device 112). For example, the bezel 132 may be formed from a polycarbonate material. and/or any other suitable material and may be hydrophobic or hydrophilic. Furthermore, together, the housing 102 and the bezel 132 may form a remote speaker microphone that contains other features of the portable electronic device 100 as described herein; for example, the bezel 132 may removably mate with the housing 102 via any suitable combination of fasteners (e.g. snaps, clips, and the like). The remote speaker microphone may be used to conduct calls via the portable electronic device 100, including, but not limited to, voice calls via communication networks (e.g. as described below with respect to FIG. 8), push-to-talk calls, and the like, and/or activate other functionality such receive voice commands, transmit location notifications, and the like, and/or any other suitable functionality.

In general, one or more of the housing 102 and the bezel 132 includes drainage features 134-1, 134-2. For example, drainage features 134-1 of the bezel 132 may include ports, and/or elongate ports, such as speaker ports and/or elongate speaker ports, and the like, through the bezel 132, such that moisture that collects at the hydrophobic mesh 108, in a region that is closest to a speaker-facing side of bezel 132 (e.g. in a location of the central aperture 118C) wicks to the bezel 132, due to capillary action, and through the ports, and drains out of the portable electronic device 100. Hence the drainage features 134-1 may act as path for sound from the speaker 106 to exit the portable electronic device 100, as well as a path for moisture to enter and exit the portable electronic device 100. The shape and/or size and/or number and/or configuration of the drainage features 134-1 may be any suitable shape and/or size and/or number and/or configuration that achieves such functionality.

Details of such drainage through the drainage features 134-1 are further described below with respect to FIG. 7.

Similarly, with reference to FIG. 2, the drainage features 134-2 of the housing 102 may comprise channels in the housing 102 and/or ports in a combination of the housing 102 and the bezel 132 (e.g. formed where the housing 102 and the bezel 132 meet) such that moisture that collects at the hydrophobic mesh 108 runs towards the channels (e.g. due to the canopy shape of the underlying 3D retainer 110) and drains out of the portable electronic device 100 through ports. Details of such drainage are further described below with respect to FIG. 5 and FIG. 6.

The portable electronic device 100 may generally comprise any other suitable features and which may depend on the functionality of the portable electronic device 100. For example, as depicted, the portable electronic device 100 may comprise an RSM. As such, with reference to FIG. 1 and FIG. 2, the portable electronic device 100 may further (optionally) comprise a button 136, which may be assigned any suitable functionality including, but not limited to, indicating that a voice command is to be received at a microphone of the portable electronic device 100 (e.g. via microphones 138, described in more detail below), answering and/or ending a call and/or a voice call, transmitting a location notification and the like. In some examples, functionality of the button 136 (e.g. when present) may be programmable.

As best seen in FIG. 2, the portable electronic device 100 may comprise any suitable biasing device 140 configured to bias the button 136 outwards (e.g. such as spring, a switch, and the like) from the bezel 132; the button 136 and/or the biasing device 140 may include an electronic switch, and the like, that is actuated by the button 136 being depressed and/or actuated. As also best seen in FIG. 2, the aperture-free region 130 of the 3D retainer 110 is located so as to as provide a surface against which the biasing device 140 interacts. While the hydrophobic mesh 108 may also be at the aperture-free region 130, to lower cost, as depicted, the aperture-free region 130 may be free of the hydrophobic mesh 108 with a shape of the hydrophobic mesh 108 adjusted accordingly. Hence, a configuration and/or sizes and/or shapes of the aperture-free region 130 and/or the biasing device 140 may be adapted to accommodate the apertures 118 and/or a location of the button 136 relative to the apertures 118.

Again with reference to FIG. 1 and FIG. 2, the portable electronic device 100 may further comprise a microphone and/or microphones 138, for example located behind a corresponding grill 142 in the bezel 132.

In a particular example, the button 136 may be assigned voice command and/or voice control functionality and hence may alternatively be referred to as the voice-control button 136. It is further understood that the portable electronic device 100 may comprise other buttons in other locations at the housing 102, and the like, for example, a push-to-talk button 144 at a side of the housing 102 as best seen in FIG. 1, for use in controlling push-to-talk calls when the portable electronic device 100 is an RSM (e.g. using the speaker 106 and the microphones 138). As such, in these specific examples, the portable electronic device 100 is understood to be an RSM with a push-to-talk button 144 on a side of the housing 102 and the voice-control button 136 on a front of the housing 102 (and/or a front of the bezel 132), and the 3D retainer 110 comprises the aperture-free region 130 behind the voice-control button 136.

Again with reference to FIG. 1, the portable electronic device 100 may further comprise a communication link 146 to a transceiver, the speaker 106 and the microphone(s) 138 connected to the transceiver via the communication link 146.

Figure 5:
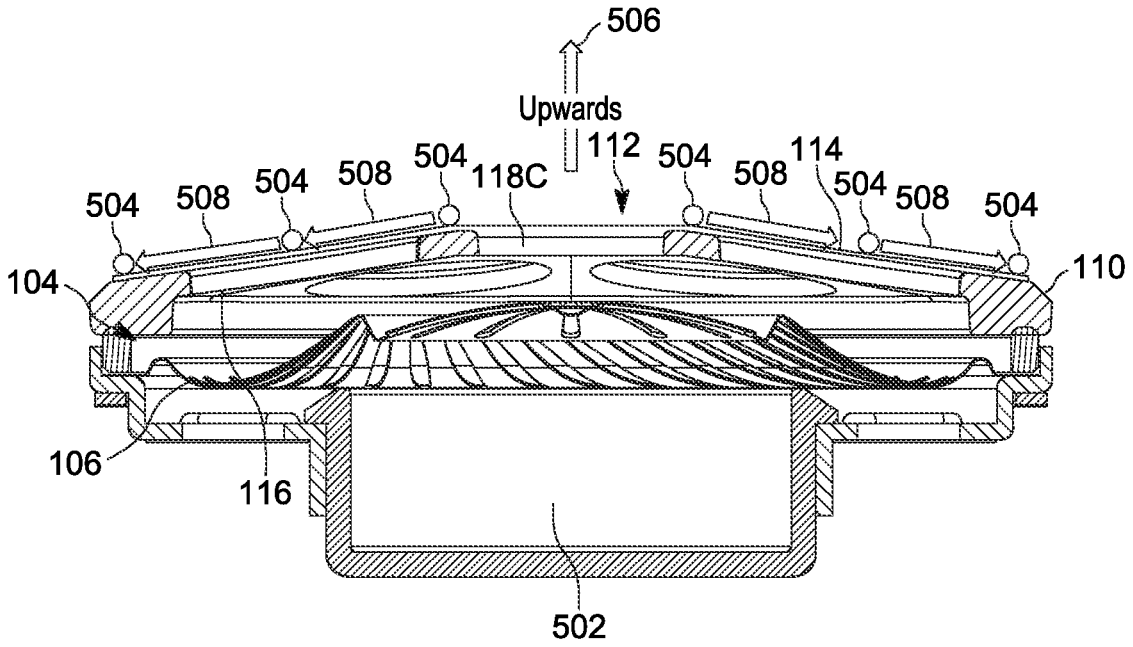
FIG. 5 depicts a lateral cross-section of a portion of the device of FIG. 1 that includes a three-dimensional canopy shaped retainer and hydrophobic mesh and a speaker, with the portion facing in an upwards direction in accordance with some examples.

Attention is next directed to FIG. 5, which depicts a lateral cross-section of the hydrophobic mesh 108 attached to the 3D retainer 110 (e.g. the device 112), the speaker 106 (including a yoke portion 502 thereof) and the portion of the housing 102 that includes the cavity 104. FIG. 5 also depicts the inner side 116 of the 3D retainer 110 as being faceted, similar to the outer side 114, though the inner side 116 may have any suitable configuration.

Also depicted in FIG. 5 is moisture 504 (e.g. as depicted, water droplets) which may enter the portable electronic device 100 via the speaker ports of the drainage features 134-1. Put another way, while the drainage features 134-1 may act to drain moisture from the portable electronic device 100 (e.g. see FIG. 7), and further act as speaker ports for sound from the speaker 106 to exit the portable electronic device 100, such speaker ports of the drainage features 134-1 also generally act as apertures through which the moisture 504 may enter the portable electronic device 100 and collect at the hydrophobic mesh 108, potentially blocking sound from the speaker 106.

Indeed, FIG. 5 further depicts a worst case scenario for such collection of moisture 504 at the hydrophobic mesh 108. In particular, as depicted, the outer side 114 of the 3D retainer 110 is facing in an upwards direction, as indicated by an arrow 506. Similarly, the speaker 106 is also facing in an upwards direction. As such, if the outer side 114 were of a uniform flatness (e.g. rather than being convex) the moisture 504 might generally reside at the hydrophobic mesh 108, blocking sound from the speaker 106. Alternatively, if the hydrophobic mesh 108 and the 3D retainer 110 were not present, the moisture 504 would generally pool in the speaker 106, blocking sound from the speaker 106 and/or damaging the speaker 106.

However, as the outer side 114 of the 3D retainer 110 is convex, the moisture 504 at the hydrophobic mesh 108, runs in a downward direction (e.g. due to gravity) away from a center of the 3D retainer 110 (e.g. away from a location of the central aperture 118C) and towards edges of the 3D retainer 110, as indicated by arrows 508. Furthermore, as the hydrophobic mesh 108 is hydrophobic, the moisture 504 generally forms contact angles of greater than 90° (e.g. the moisture 504 is repelled), which promotes movement of the moisture 504 along a surface of the hydrophobic mesh 108.

Attention is next directed to FIG. 6 which depicts the portable electronic device 100 with the bezel 132 removed, and with the outer side 114 of the outer side 114 of the 3D retainer 110 facing in the upwards direction, as again indicated by the arrow 506 (e.g. now pointing out of the page). Put another way, the orientation of the portable electronic device 100, as well as the speaker 106, the hydrophobic mesh 108 and the 3D retainer 110 in FIG. 6 is similar to the orientation of the speaker 106, the hydrophobic mesh 108 and the 3D retainer 110 in FIG. 5.

Also depicted in FIG. 6 are three drops of moisture 504 which are running in a downward direction along the hydrophobic mesh 108. As depicted via arrows 602, the moisture 504 may run out of the portable electronic device 100 via the drainage features 134-2, which may comprise apertures and/or holes in the housing 102 (e.g. which may also be formed via the bezel 132). Regardless, the drainage features 134-2 provide regions of egress of the moisture 504 at least when the speaker 106, the hydrophobic mesh 108 and the 3D retainer 110 are oriented in an upwards direction.

However, depending on location, the drainage features 134-2 may drain the moisture 504 from the portable electronic device 100 in other orientations. For example, the drainage feature 134-2 located adjacent the communication link 146 may include channels which drain the moisture 504 from the portable electronic device 100, through an aperture adjacent the communication link 146, when the portable electronic device 100 is held upright (e.g. such that a top of the housing 102 is upwards); in particular, as depicted, the drainage feature 134-2 located adjacent the communication link 146, may comprise two channels on opposite sides of the communication link 146 from the device 112 to the aperture, which is formed by the housing 102 and the bezel 132.

Similarly, the drainage features 134-2 at opposing sides of the housing 102 may drain the moisture 504 from the portable electronic device 100 when the portable electronic device 100 is held sideways (e.g. such that a "left" or "right" side of the housing 102 is upwards). In particular, the drainage features 134-2 at opposing sides of the housing 102 may comprise apertures formed by the housing 102 and the bezel 132.

It is hence further understood that the interior of the portable electronic device 100 may be waterproofed in any suitable manner, at least in the regions of the interior of the portable electronic device 100 where the moisture 504 flows to the drainage features 134-2.

For completeness, FIG. 6 also depicts bolts 604 through bolt holes of the wings 120 that attach the 3D retainer 110 to the housing 102.

Figure 7:
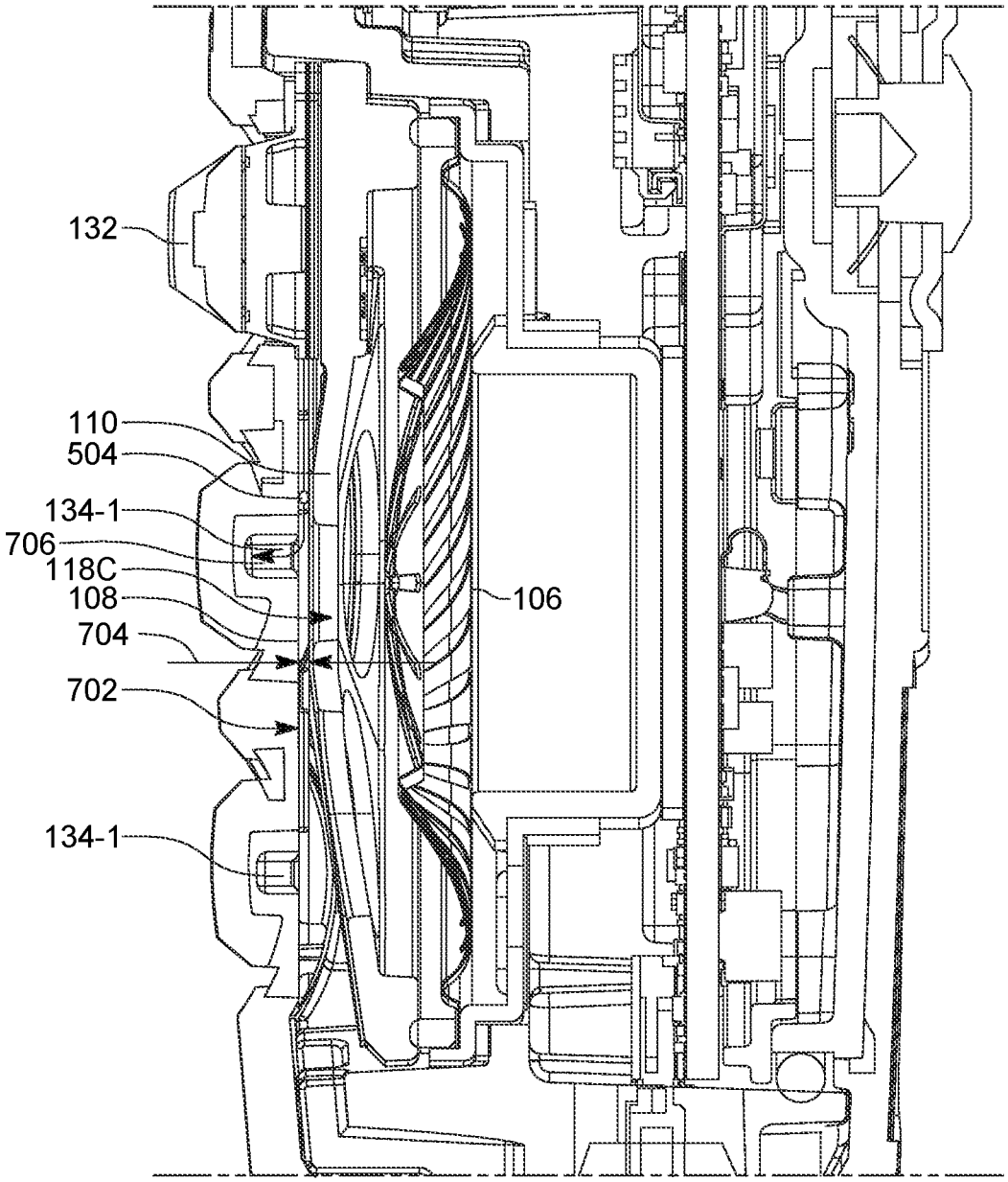
FIG. 7 depicts a block diagram of a cross-section of a portion of the device of FIG. 1 through a line A-A shown in FIG. 1, in accordance with some examples.

Attention is next directed to FIG. 7, which depicts a cross-section of the region 101 of the portable electronic device 100 through the line A-A. As depicted, a speaker-facing side 702 of the bezel 132 may be located a given distance 704 from a closest portion (e.g. at the central aperture 118C) of a combination of the 3D retainer 110 and the hydrophobic mesh 108, the given distance 704 selected to wick moisture 504 away from, and/or along, the closest portion towards the drainage features 134-1. For example, as depicted, the moisture 504 may be wicked between the speaker-facing side 702 of the bezel 132, and the closest portion of the combination of the 3D retainer 110 and the hydrophobic mesh 108, towards a drainage feature 134-1 of the bezel 132 and out of the portable electronic device 100 via the speaker ports of the drainage feature 134-1, as indicated by an arrow 706. Alternatively, the moisture 504 may be wicked away from the closest portion of the combination of the 3D retainer 110 and the hydrophobic mesh 108, and along the hydrophobic mesh 108, such that the moisture 504 exits the portable electronic device 100 via a drainage feature 134-, similar to as depicted in FIG. 6.

In general, such wicking may occur due to capillary action, and/or a combination of capillary action and gravity. As such, the distance 704 between the bezel 132 (e.g. the speaker-facing side 702 thereof) and the closest portion of the combination of the 3D retainer 110 and the hydrophobic mesh 108, as well as a size and/or shape of the speaker ports of the drainage features 134-1, may be selected to promote capillary action to the speaker ports of the drainage features 134-1 such that the moisture 504 is wicked through the speaker ports of the drainage features 134-1 and out of the portable electronic device 100. In some examples, the distance 704 between the bezel 132 and the closest portion of the combination of the 3D retainer 110 and the hydrophobic mesh 108 may be in a range of about 0.2 mm to about 1.0 mm; in a particular example, the distance 704 between the bezel 132 and the and the closest portion of the combination of the 3D retainer 110 and the hydrophobic mesh 108 may be about 0.5 mm.

Put another way, the bezel 132 may be spaced from the closest portion of the combination of the 3D retainer 110 and the hydrophobic mesh 108 at a distance 704 selected to wick the moisture 504 away from, and/or along, the closest portion of the combination of the 3D retainer 110 and the hydrophobic mesh 108 due to capillary action.

Hence, various mechanisms for drainage of moisture are provided, with one or more of the housing 102 and the bezel 132 including drainage features 134-1, 134-2.

Furthermore, when the speaker ports of the drainage features 134-1 through the bezel 132 are present, drainage of moisture 504 out of portable electronic device 100 does not generally depend on the portable electronic device 100 being held in a particular direction, for example due to the canopy shape of the device 112, the locations of the various drainage features 134-1, 134-2, and the capillary action described with respect to FIG. 7.

Figure 8:
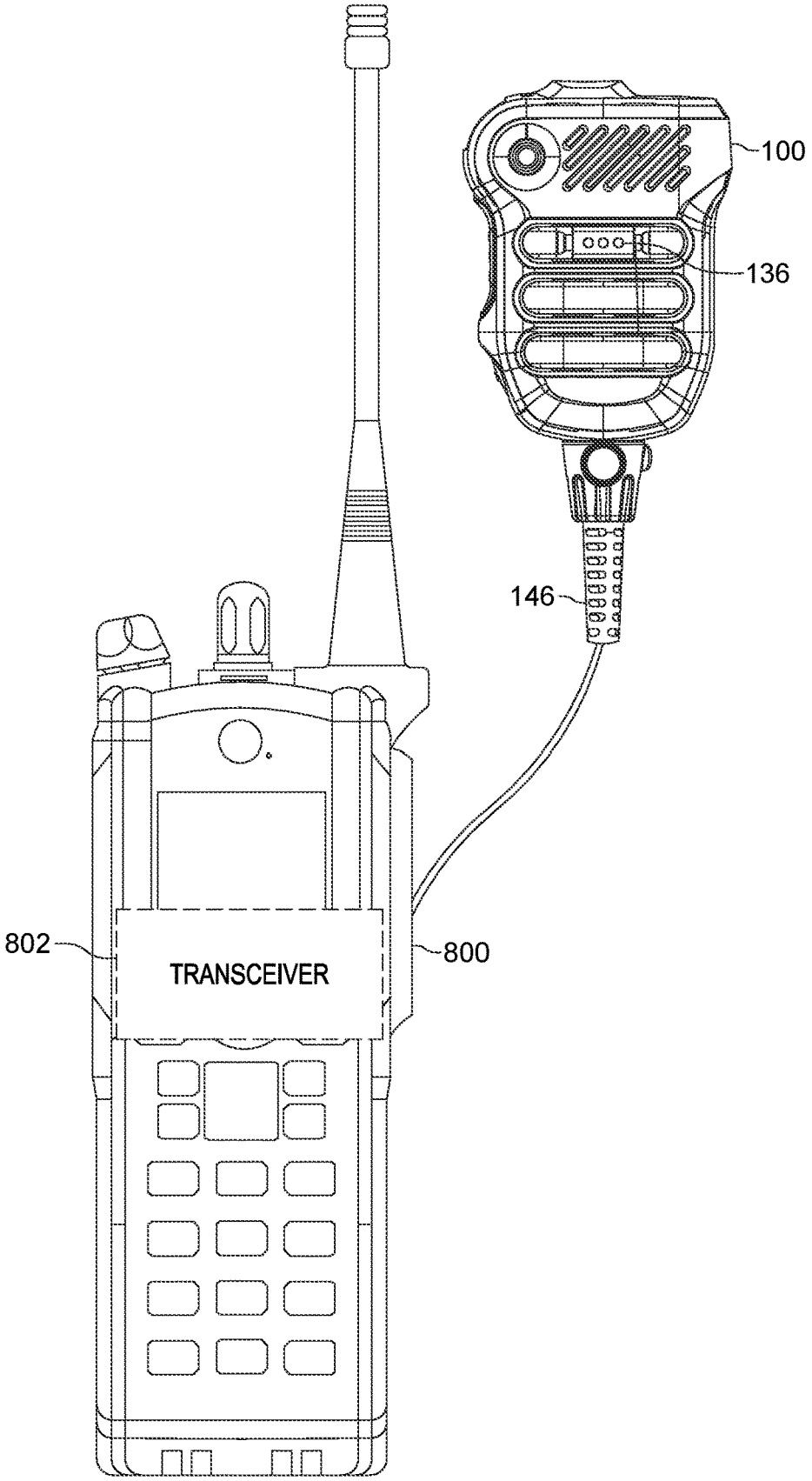
FIG. 8 depicts a portable electronic device that incorporates the device of FIG. 1, in accordance with some examples.

Attention is next directed to FIG. 8 which depicts, the portable electronic device 100 as component of a larger communication device 800 (interchangeably referred to herein as the device 800), that includes a transceiver 802 and/or a radio. In FIG. 8, the transceiver 802 is depicted in broken lines indicating that the transceiver 802 is located internal to the device 800. As depicted, the device 800 comprises a portable radio, and the portable electronic device 100 comprises an RSM of the device 800, though the devices 100, 800 may comprise any suitable portable device and/or component thereof. The device 800, in combination with the portable electronic device 100 may hence be used to conduct calls via the transceiver 802, including, but not limited to, voice calls, push-to-talk calls, and the like. Furthermore, the device 800 may comprise a location determining device, such as a Global Positioning System (GPS) device, and the like. The button 136 may be programmed (e.g. via computer program instructions stored at the device 800 and/or the portable electronic device 100) to implement functionality at the device 800, when actuated, including but not limited to indicating that a voice command is to be received at a microphone 138 of the portable electronic device 100 (e.g. and which may be implemented at the device 800 and/or the portable electronic device 100), answering and/or ending a call and/or a voice call, transmitting a location notification (e.g. to a location server, the location notification comprising a location determined by a location determining device), and/or any other suitable functionality.

As depicted, the communication link 146 comprise a wired communication link with the transceiver 802; however, in other examples, the communication link 146 may be wireless.

Regardless, the device 800 is understood to include the portable electronic device 100, including the communication link 146 to the transceiver 802, with the speaker 106 and the microphone(s) 138 connected to the transceiver 802 via the communication link 146.

Hence, the portable electronic device 100 and/or the device 800 is generally configured to provide water drainage for a speaker thereof using a three-dimensional canopy shaped retainer and hydrophobic mesh. Furthermore, the device 800 may also include a speaker, and hence the device 112 may be adapted for integration with the device 800 and/or any other suitable device that includes a speaker.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element (s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "one of", without a more limiting modifier such as "only one of", and when applied herein to two or more subsequently defined options such as "one of A and B" should be construed to mean an existence of any one of the options in the list alone (e.g., A alone or B alone) or any combination of two or more of the options in the list (e.g., A and B together).

Similarly, in this document, language of "at least one of X, Y, and Z" and "one or more of X, Y and Z" may be construed as X only, Y only, Z only, or any combination of two or more items X, Y, and Z (e.g., XYZ, XY, YZ, XZ, and the like). Similar logic may be applied for two or more items in any occurrence of "at least one . . . " and "one or more . . . " language.

A device or structure that is "configured" in a certain way is configured in at least that way, but may also be configured in ways that are not listed.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through intermediate elements or devices via an electrical element, electrical signal or a mechanical element depending on the particular context.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A device comprising:

a three-dimensional (3D) retainer having a canopy shape with an outer side and an inner side, the outer side having a generally convex shape and the inner side having a generally concave shape, the 3D retainer comprising apertures therethrough; and a hydrophobic mesh located at least at the apertures at the outer side of the 3D retainer, the hydrophobic mesh being air-permeable, wherein, when the outer side of the 3D retainer is facing in an upwards direction, moisture at the hydrophobic mesh, runs in a downward direction away from a center of the 3D retainer.

2. The device of claim 1, wherein regions around the apertures comprise flat facets to which the hydrophobic mesh is attached.

3. The device of claim 1, wherein regions around the apertures comprise flat facets to which the hydrophobic mesh is attached, the flat facets forming angles with adjacent flat facets to form the generally convex shape.

4. The device of claim 1, wherein one aperture, of the apertures, is centrally located at the 3D retainer, and remaining apertures are located around the one aperture.

5. The device of claim 1, wherein the 3D retainer comprises one or more of a metal, steel, stainless steel, and a hard plastic, having a thickness in a range of about 0.8 mm to about 1.5 mm.

6. The device of claim 1, wherein the apertures have a diameter in range of about 9 mm to about 12 mm.

7. The device of claim 1, wherein the hydrophobic mesh comprises one or more of a monofilament-based technical fabric and polyvinyl coated polyester (PES).

8. The device of claim 1, wherein the hydrophobic mesh comprises mesh apertures having a size of between about 20 microns and about 300 microns.

9. The device of claim 1, further comprising a double-sided adhesive material, the hydrophobic mesh attached to the 3D retainer with the double-sided adhesive material.

10. A portable electronic device comprising:

a housing having a cavity;

a speaker mounted in the cavity;

a three-dimensional (3D) retainer over at least a portion of the cavity, including the speaker, the 3D retainer having a canopy shape with an outer side and an inner side facing the speaker, the outer side having a generally convex shape and the inner side having a generally concave shape, the 3D retainer comprising apertures therethrough; and a hydrophobic mesh located at least at the apertures at the outer side of the 3D retainer, the hydrophobic mesh being air-permeable, wherein when the outer side of the 3D retainer is facing in an upwards direction, moisture at the hydrophobic mesh, runs in a downward direction away from a center of the 3D retainer.

11. The portable electronic device of claim 10, wherein regions around the apertures comprise flat facets to which the hydrophobic mesh is attached.

12. The portable electronic device of claim 10, wherein regions around the apertures comprise flat facets to which the hydrophobic mesh is attached, the flat facets forming angles with adjacent flat facets to form the generally convex shape.

13. The portable electronic device of claim 10, wherein one aperture, of the apertures, is centrally located at the 3D retainer at about a respective center of the speaker, and remaining apertures are located around the one aperture.

14. The portable electronic device of claim 10, wherein the hydrophobic mesh comprises one or more of a monofilament-based technical fabric and polyvinyl coated polyester (PES).

15. The portable electronic device of claim 10, wherein the apertures have a diameter in range of about 9 mm to about 12 mm.

16. The portable electronic device of claim 10, further comprising a bezel covering a combination of the 3D retainer and the hydrophobic mesh, one or more of the housing and the bezel including drainage features.

17. The portable electronic device of claim 10, further comprising a bezel covering a combination of the 3D retainer and the hydrophobic mesh, a speaker-facing side of the bezel located a given distance from a closest portion of a combination of the 3D retainer and the hydrophobic mesh, the given distance selected to wick the moisture away from, or along, the closest portion towards drainage features of one or more of the housing and the bezel.

18. The portable electronic device of claim 10 further comprising:

a bezel covering a combination of the 3D retainer and the hydrophobic mesh;

a button; and a biasing device configured to bias the button outwards from the bezel, and wherein the 3D retainer further comprises a flat, aperture free region against which the biasing device interacts.

19. A portable electronic device comprising:

a housing having a cavity;

a speaker mounted in the cavity;

a three-dimensional (3D) retainer over at least a portion of the cavity, including the speaker, the 3D retainer having a canopy shape with an outer side and an inner side facing the speaker, the outer side having a generally convex shape and the inner side having a generally concave shape, the 3D retainer comprising apertures therethrough;

a hydrophobic mesh located at least at the apertures at the outer side of the 3D retainer, the hydrophobic mesh being air-permeable; and a bezel covering a combination of the 3D retainer and the hydrophobic mesh, one or more of the housing and the bezel including drainage features.

20. The portable electronic device of claim 19, further comprising one or more of:

a speaker-facing side of the bezel that is located a given distance from a closest portion of a combination of the 3D retainer and the hydrophobic mesh, the given distance selected to wick moisture away from, or along, the closest portion towards the drainage features of one or more of the housing and the bezel; and a combination of a button and a biasing device configured to bias the button outwards from the bezel, wherein the 3D retainer further comprises a flat, aperture free region against which the biasing device interacts.

* * * * *